US011814896B1

(12) United States Patent
Velazquez

(10) Patent No.: US 11,814,896 B1
(45) Date of Patent: Nov. 14, 2023

(54) SECURITY SHUTTER ASSEMBLY

(71) Applicant: Ernesto Velazquez, Philadelphia, PA (US)

(72) Inventor: Ernesto Velazquez, Philadelphia, PA (US)

( * ) Notice: Subject to any disclaimer, the term of this patent is extended or adjusted under 35 U.S.C. 154(b) by 381 days.

(21) Appl. No.: 17/184,224

(22) Filed: Feb. 24, 2021

(51) Int. Cl.
*E06B 7/09* (2006.01)
*E06B 9/00* (2006.01)

(52) U.S. Cl.
CPC ..... *E06B 7/09* (2013.01); *E06B 2009/005* (2013.01)

(58) Field of Classification Search
CPC ..... E06B 7/09; E06B 7/084; E06B 2009/005; E06B 2009/135; E06B 2009/1516; E06B 2009/1505
See application file for complete search history.

(56) References Cited

U.S. PATENT DOCUMENTS 5,490,353 A * 2/1996 McLaughlin ..... E06B 7/084 49/64
2006/0289123 A1* 12/2006 Corey ..... E06B 7/09 160/166.1
2008/0009961 A1* 1/2008 Dick ..... B27B 27/02 700/114
2008/0127598 A1* 6/2008 Kallstrom ..... F41H 5/0485 52/656.7
2015/0368962 A1* 12/2015 Motosko ..... E04H 9/14 160/107
2018/0135351 A1* 5/2018 Walker ..... E06B 9/264
2020/0199929 A1* 6/2020 Tostee ..... E06B 7/096
2021/0047881 A1* 2/2021 Wong ..... E06B 9/15

FOREIGN PATENT DOCUMENTS

CN 203462968 U * 3/2014 ..... E06B 7/09
WO WO-2016187332 A1 * 11/2016 ..... E06B 1/04

* cited by examiner

*Primary Examiner* — Daniel P Cahn
*Assistant Examiner* — Jeremy C Ramsey
(74) *Attorney, Agent, or Firm* — Caesar Rivise, PC

(57) ABSTRACT

A decorative shutter assembly securable to an opening of a building for security and storm protection. The shutter assembly includes a shutter frame that is hingedly mounted within a mounting assembly. The shutter assembly includes a plurality of operable shutter slats that extend between vertical shutter columns. Each shutter slat includes an elongate decorative shell disposed over an inner skeletal structure. The inner skeletal structure includes a pair of spaced-apart lateral louver rods extending the length of the decorative shell and a plurality of end caps which are affixed at respective ends of the lateral louver rods. A central rod extends the length of the decorative shell and is arranged for mounting within the shutter columns to enable pivotal movement of the shutter slats between closed and open positions.

11 Claims, 10 Drawing Sheets

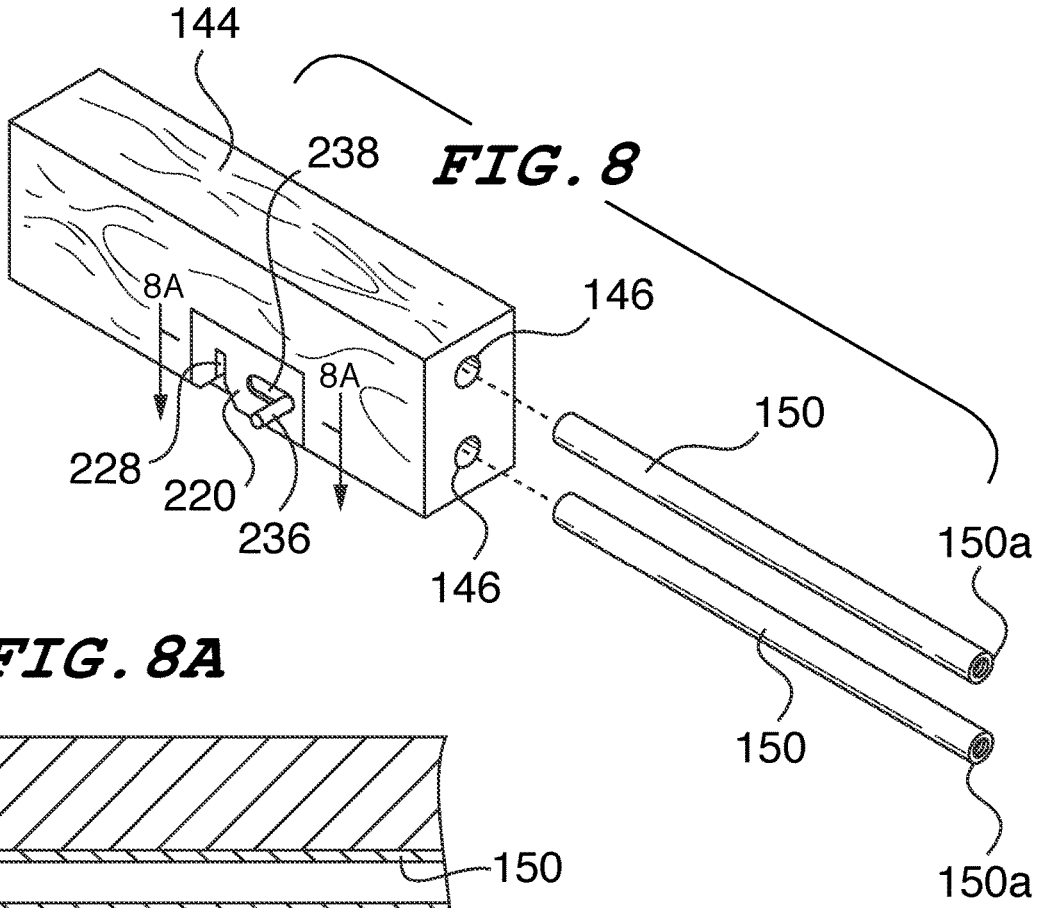
FIG. 8
FIG. 8A
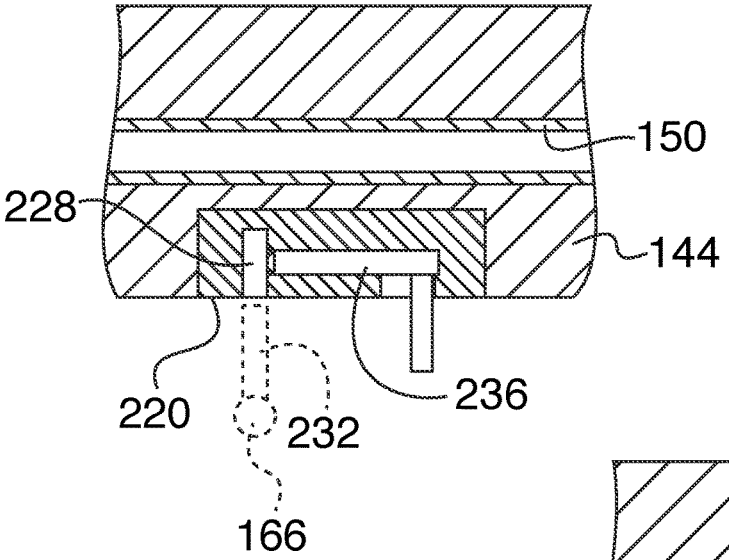
FIG. 8B
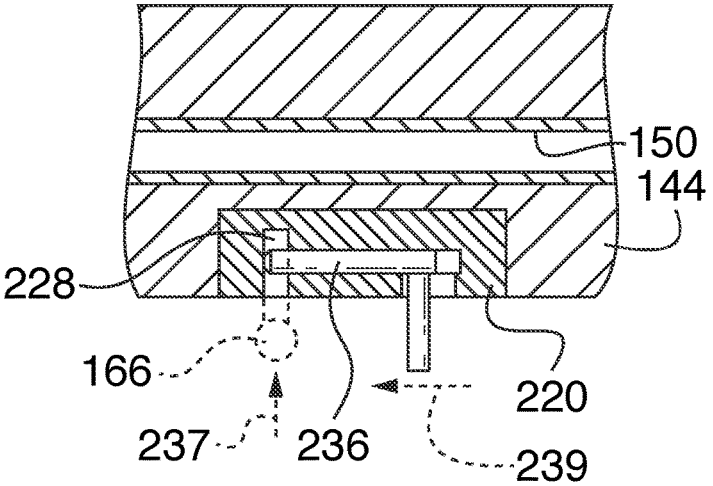

104
156
212
108
150
128
144
200
140
156
156
160
166
164
160
180
168
192
192
196
168
160
160
148
156
156
156
212
128
104
204

SECURITY SHUTTER ASSEMBLY

FIELD OF THE INVENTION

The present disclosure relates generally to security and hurricane shutters, and more particularly to a security and hurricane shutter that provides for security while remaining aesthetically pleasing.

BACKGROUND OF THE INVENTION

For purposes of security, fixed bars and grating have been used to protect against unwanted entry by way of windows and other exterior apertures of structures. Such exterior bars can be routinely seen adorning the windows of homes and businesses in high crime areas. Moreover, as crime has moved into prosperous areas, such exterior bars can be seen in more affluent areas formerly believed to be secure.

Such bars and grates often take the form of fixed locking bars or grating on the exterior of windows. These security measures are useful in that they allow light to enter the window that the device is securing. They also allow individuals inside the adjoining room to see outside the protected window. However, bars and grates can be dangerously restrictive in the event of an emergency, where fast egress is needed, such as in the event of a fire. Another typical form of security is a roll-up barrier that functions similar to a paneled garage door. This form of security is even more restrictive than the above-mentioned bars and grates in that the roll-up barrier generally does not allow the entry of light nor does it allow vision outside the secured window. In addition, the roll-up barrier suffers from the same dangerously restrictive deficiency as set forth above with respect to the bars and grates.

A further disadvantage of the prior art security devices discussed above, is that they are all generally considered unattractive. For example, homes having locked security bars installed on the windows can in fact dissuade potential home buyers from purchasing the home because of both the unattractiveness of such devices and a perceived apprehension of the neighborhood brought on by the sight of such securities measures. Buyers can further be discouraged by an apprehension of what may occur in the event of an emergency where no escape can be made from the protected windows.

The plantation or colonial shutter is a common type of shutter which is permanently attached to the interior of a window opening, and their design allows some light and air to enter the building even when closed. However, these shutters are usually made of wood, which are not strong enough to withstand hurricane winds. The wood components cannot simply be replaced with stronger materials such as metal, as the design would be too heavy and unstable in that configuration.

In view of the foregoing, there is a need for an apparatus for providing security while remaining esthetically pleasing. The apparatus should allow for essentially normal use of the secured aperture, while preventing unwanted entry. Moreover, the apparatus should allow for easy egress in the event of an emergency, while still maintaining a secure aperture.

SUMMARY OF THE INVENTION

Broadly speaking, the present invention addresses these needs by providing a security shutter assembly that looks and operates in a manner that is similar to standard shutters.

The security shutter assembly of the present invention provides security by being formed of a strong material, such as steel or other metal components. Yet, the security shutter assembly provides the appearance of standard shutters, such as standard plantation shutters formed of wood or faux wood. The security shutter assembly may be in the style of wood or faux wood plantation or colonial shutters, similar to those currently on the market. The security shutter assembly of the present invention includes a metal skeleton hidden within its decorative wood or faux wood exterior shell that provides covert protection. The security shutter assembly may be designed and manufactured in a variety of sized with variability in height and width to suit a customer's specifications.

Moreover, embodiments of the present invention allow the shutter to be easily opened from the inside to allow easy egress, yet maintains security by preventing opening of the shutter from the outside the aperture, e.g., window, or structure on which it is mounted.

DESCRIPTION OF THE DRAWINGS

FIG. 8 is an exploded isometric view of an upper horizontal member of the security shutter assembly of the present invention including a shutter slat lock body mounted therein;

FIG. 8A is a sectional view taken along line 8A-8A of FIG. 8;

FIG. 8B is a view illustrating operation of the shutter slat lock body to inhibit movement of the shutter slats from the closed position;

DETAILED DESCRIPTION OF THE PREFERRED EMBODIMENT

The particulars shown herein are by way of example and for purposes of illustrative discussion of the embodiments of the present invention only and are presented in the cause of providing what is believed to be the most useful and readily understood description of the principles and conceptual aspects of the present invention.

Embodiments are disclosed for providing a security shutter assembly having an appearance of a standard shutter, such as a traditional shutter, California shutter, plantation shutter, or other shutter having operable louvers or slats. Broadly speaking, embodiments of the present invention provide security by forming the shutter assembly from a hard metal, such as steel or galvanized steel. Components of the shutter assembly are then provided with a decorative surface that could simulate wood or another aesthetically pleasing surface to resemble a standard shutter. The embodiments of the present invention include a door locking element that can be set to a locked or an open position. When the door locking element is set to the locked position, each or both of the shutter doors may be locked within the mounting frame while the louvers or slats of the shutter can continue to be moved to any desired setting. The embodiments of the present invention also include a slat locking mechanism to lock the shutter slats in a closed position.

Figure 1:
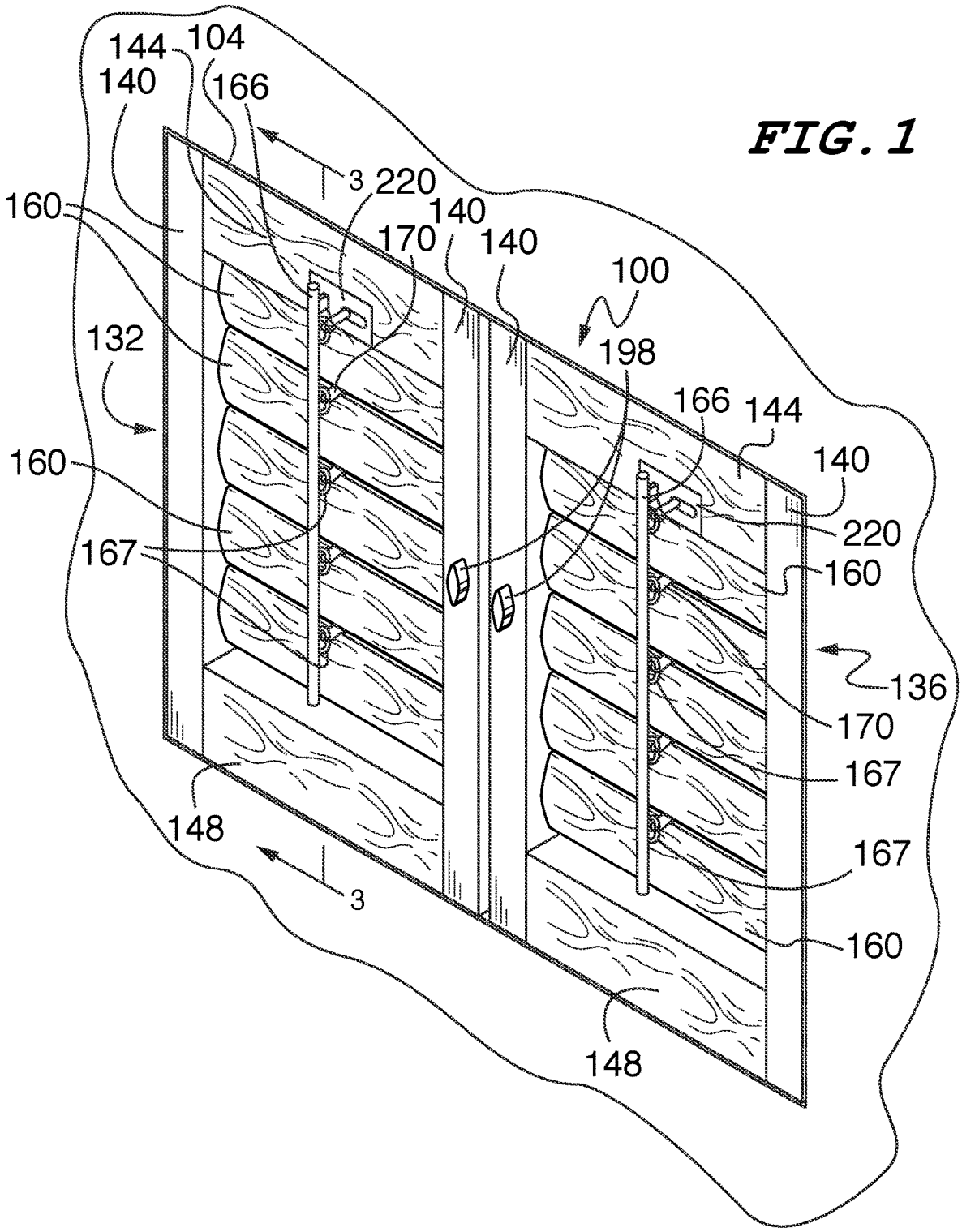
FIG. 1 is an isometric view of the preferred embodiment of the security shutter assembly of the present invention mounted in an opening for a window and viewed from inside a structure, such as a house, store, hotel, or any building.
Figure 2:
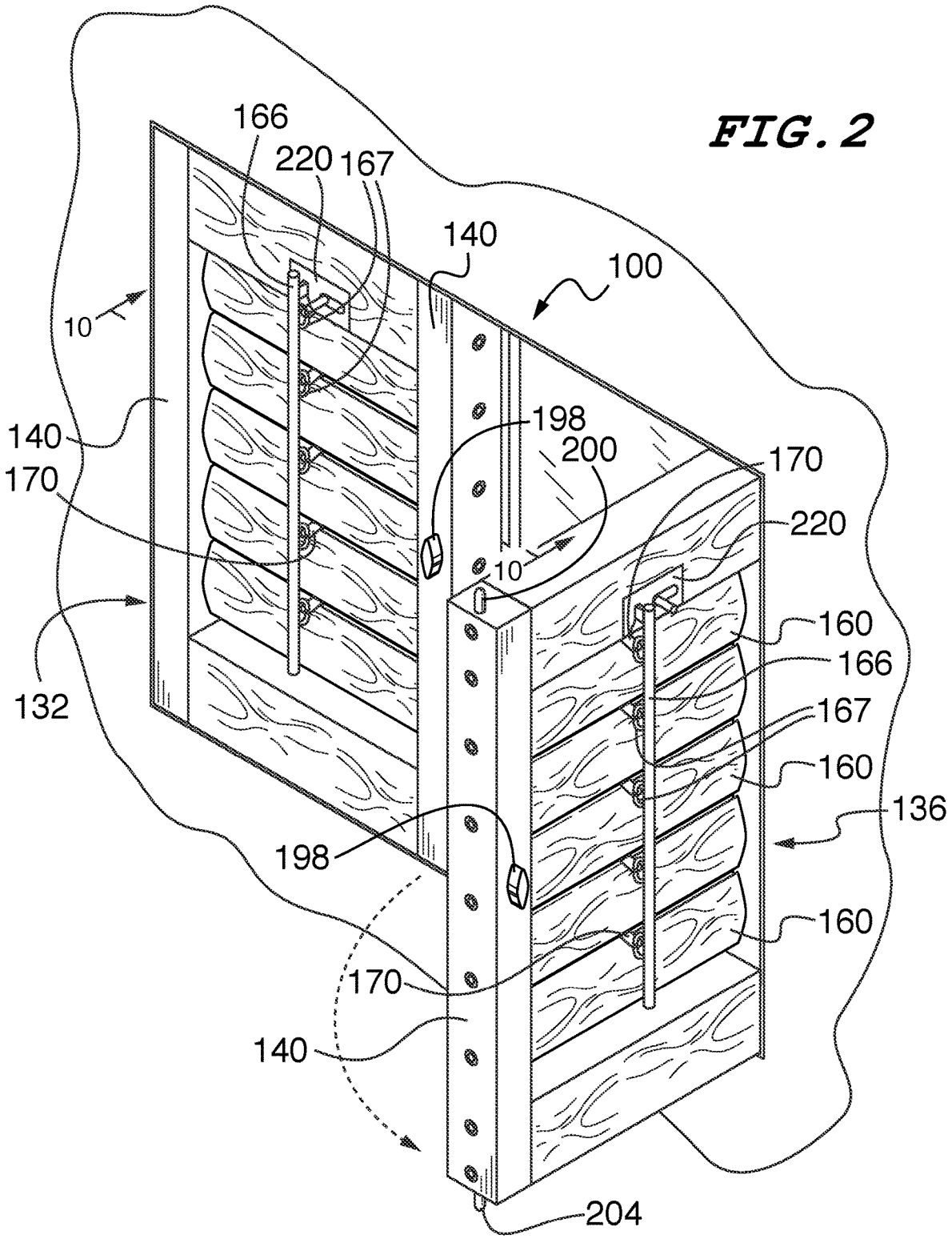
FIG. 2 is an isometric view of the preferred embodiment of the security shutter assembly of the present invention mounted in an opening for a window with the left shutter door in a closed position, the right shutter door in an open position, and the shutter slats of both the left and right doors in the closed and locked position.
Figure 3:
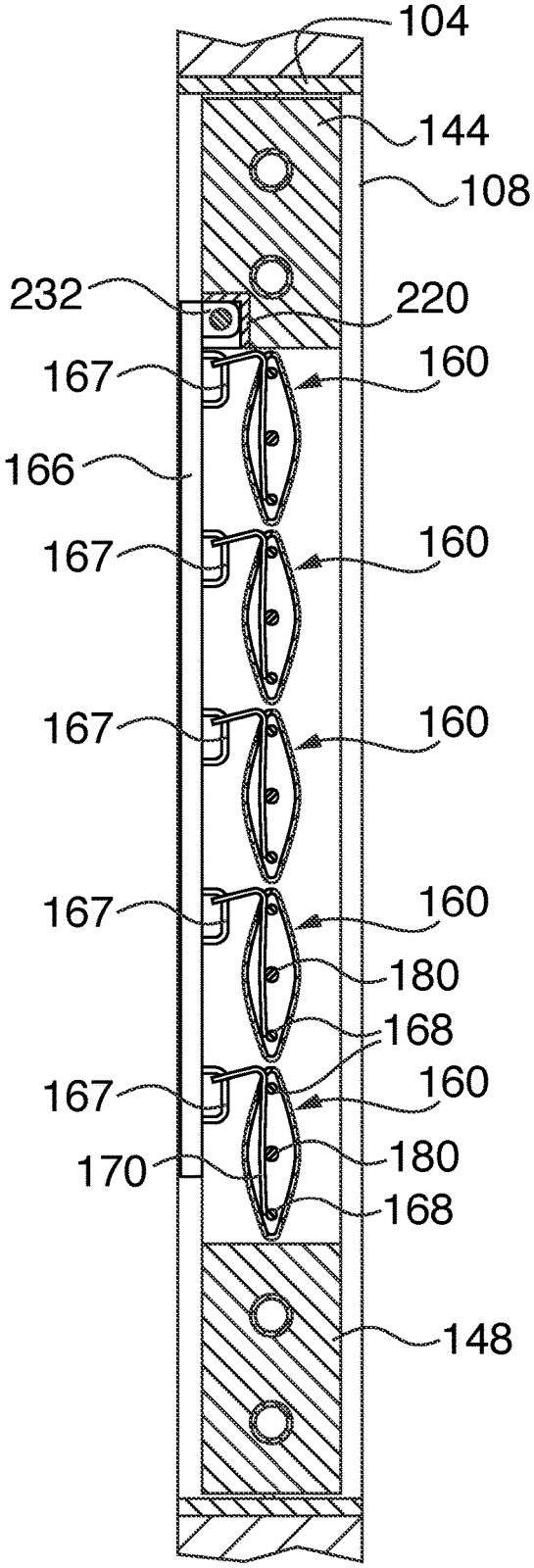
FIG. 3 is a sectional view taken along line 3-3 of FIG. 1 illustrating the shutter slats in the closed and locked position.
Figure 5:
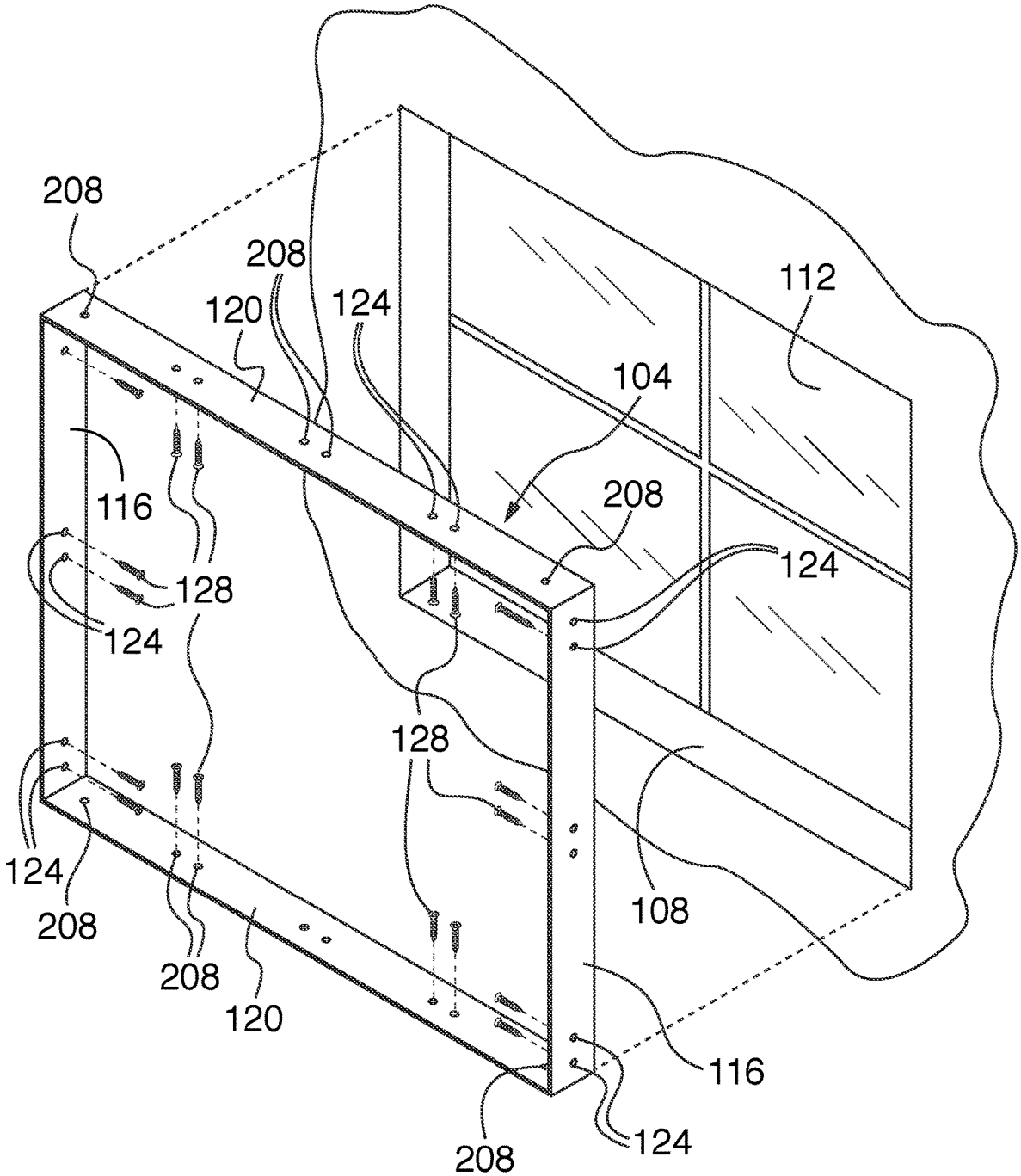
FIG. 5 is an isometric view of mounting frame of the preferred security shutter assembly illustrating the manner for affixing the mounting frame within the window opening.

Referring now to FIGS. 1, 2 and 5, a preferred embodiment 100 of the invention is shown. As best shown in FIG. 5, the preferred embodiment 100 includes a generally rectangular-shaped mounting frame 104 arranged for mounting the preferred embodiment 100 within an opening 108 located interior to a window 112, or a door of a structure, such as within a commercial or residential building. The mounting frame 104 is preferably formed of steel or another hard metal. The mounting frame 104 may be provided as a continuous generally-rectangular piece, or alternatively, may be formed of a plurality of elongated rectangle-shaped metal components, such as a pair of spaced-apart vertical components 116 joined at their ends to a pair of spaced-apart horizontal components 120. The vertical and horizontal dimensions of the mounting frame 104 may be adjusted to suit the dimensions of the opening in which the frame is to be mounted. The elongated rectangle-shaped components 116 and 120 may be joined to each other by any suitable means, e.g., suitable joining hardware, or welding, etc. As best shown in FIG. 5, the mounting frame 104 of the preferred embodiment 100 is sized and shaped to be mounted within the opening 108 located interior of the window 112, or another opening to be shuttered. In this regard, each of the rectangle-shaped components 116 and 120 includes through mounting holes 124 that are arranged in pairs spaced across the length of the rectangle-shaped components 116 and 120 to enable fastening of the mounting frame 104 to the opening 108 at a position that is adjacent to and interior of the window 112. Fastening of the mounting frame 104 to the opening 108 may be accomplished by way of suitable mounting hardware 128, e.g., screws, lag bolts, etc.

Figure 9:
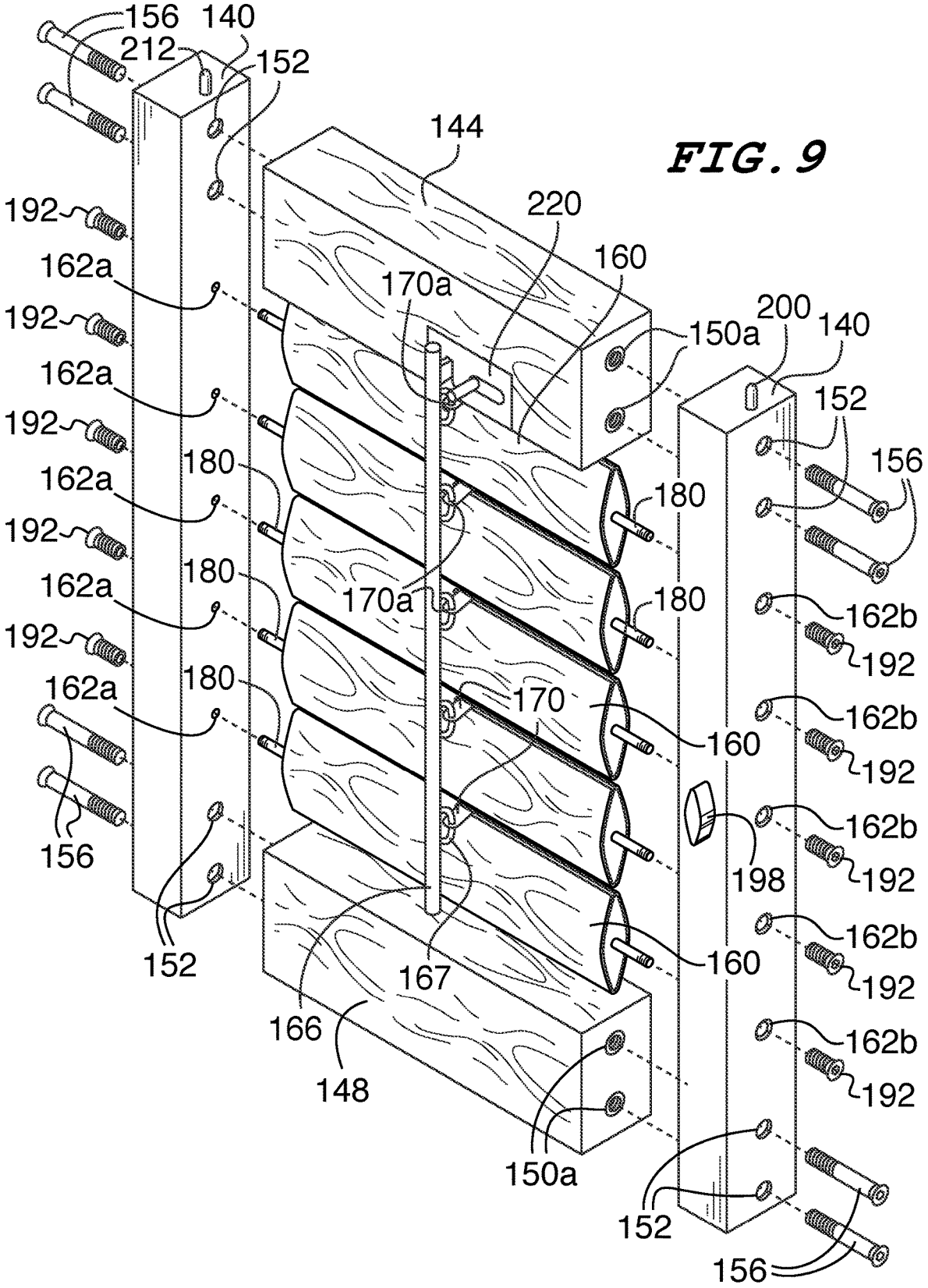
FIG. 9 is an exploded isometric view of a left shutter door of the security shutter assembly of the present invention illustrating its components.

Referring now to FIG. 2, there is shown therein a pair of shutter doors hingedly mounted within the mounting frame 104, including a left-opening shutter door 132, and a right-opening shutter door 136. In FIG. 1, both shutter doors 132 and 136 are shown in the closed position within the frame 104, with the slats 160 of both shutter doors shown in the closed and locked position. In FIG. 2, the shutter door 132 is shown in the closed and locked position within the frame 104, while the shutter door 136 is shown in the open position. Although the figures illustrate a security shutter assembly having two shutter doors, it should be noted that any number of shutter doors can be utilized using the teachings of the embodiments of the present invention, including one shutter door, four shutter doors or any other number of shutter doors as needed by a particular design application. As best shown in FIG. 9, each shutter door 132 and 136 is formed of a pair of vertically-oriented shutter columns 140. Each shutter column 140 is preferably hollow and formed of metal, such as steel, steel composite, aluminum, titanium, or other hard substance to provide reinforcement to the security shutter assembly 100 when the shutters are in a closed and locked position. Each shutter column 140 is roughly of square or rectangular cross-section, e.g., two inches by one inch. Each shutter column 140 is joined at its upper end to opposite ends of the upper horizontal member 144 and is joined at its lower end to opposite ends of the lower horizontal member 148.

Referring to FIG. 8, there is shown the upper horizontal member 144 of either shutter door 132, 136, which may be formed of any suitable material, e.g., metal, such as steel, steel composite, aluminum, titanium, or another hard substance, in which case, an aesthetically pleasing surface, a wood grain surface would be added, e.g., a wood surface, a wood veneer, a composite wood, a faux wood, etc. Alternatively, the upper horizontal member 144 may be formed of a solid block of wood, as best shown in FIG. 8. The upper horizontal member 144 includes a pair of through openings 146. A pair of elongate mounting rods 150 are provided, each mounting rod 150 including an internally threaded bore 150*a* at each end thereof. The mounting rods 150 may be formed of any suitable hard materials, e.g., a metal such as steel, steel composite, aluminum, or titanium, and may be in the form of a solid rod or a hollow tube, e.g., one inch in diameter. The mounting rods 150 are arranged to extend through the openings 146 to enable mounting of the upper horizontal member 144 to the shutter columns 140. The lower horizontal member 148 is of similar construction and includes an aesthetically pleasing surface that may match that of the upper horizontal member 144.

Again, referring to FIG. 9, each vertical shutter column 140 is provided with pairs of through mounting holes 152 located at its upper and lower ends thereof. Specifically, at the upper end of each vertical shutter column 140, a pair of through mounting holes 152 is located on the inner surface of the shutter column, as well as on the outer surface of the shutter column 140. Likewise, at the lower end of each shutter column 140, a pair of through mounting holes 152 is located on the inner surface and outer surface of each shutter column 140. The through mounting holes 152 on the upper and lower ends of each shutter column are located to match with the through openings 146 located on the upper and lower horizontal members, 144 and 148, respectively. In this manner, suitable hardware, e.g., mounting bolts 156 may be inserted through the mounting holes 152 and into the internal threaded bores of the mounting rods 150 disposed within the upper and lower horizontal members to secure the upper and lower horizontal members 144 and 148 to the shutter columns 140. Once bolted together, the shutter columns 140 and upper and lower horizontal members 144 and 148 form a generally rectangle-shaped frame of rigid construction to withstand high winds, flying debris, and falling objects caused by severe weather, as well as to withstand attempted intrusions. The frame is also provided for mounting a plurality of operable shutter slats 160 therein, as discussed below.

Each shutter column 140 is also provided with a series of slat mounting openings 162*a* and 162*b* located on the outer and inner surfaces thereof. The slat mounting openings 162*a* and 162*b* are spaced from each other at a predetermined distance along the height of each shutter column 140. As best shown in FIG. 9, each shutter column 140 is provided with five slat mounting openings 162*a* located along the inner surface thereof and five slat mounting openings 162*b* located along the outer surface thereof, the slat mounting openings 162*a* and 162*b* being arranged for mounting of shutter slats 160. It should be understood that a greater or fewer number of slat mounting openings may be utilized to accommodate a greater or fewer number of shutter slats 160, without departing from the scope of the invention.

Figure 6:
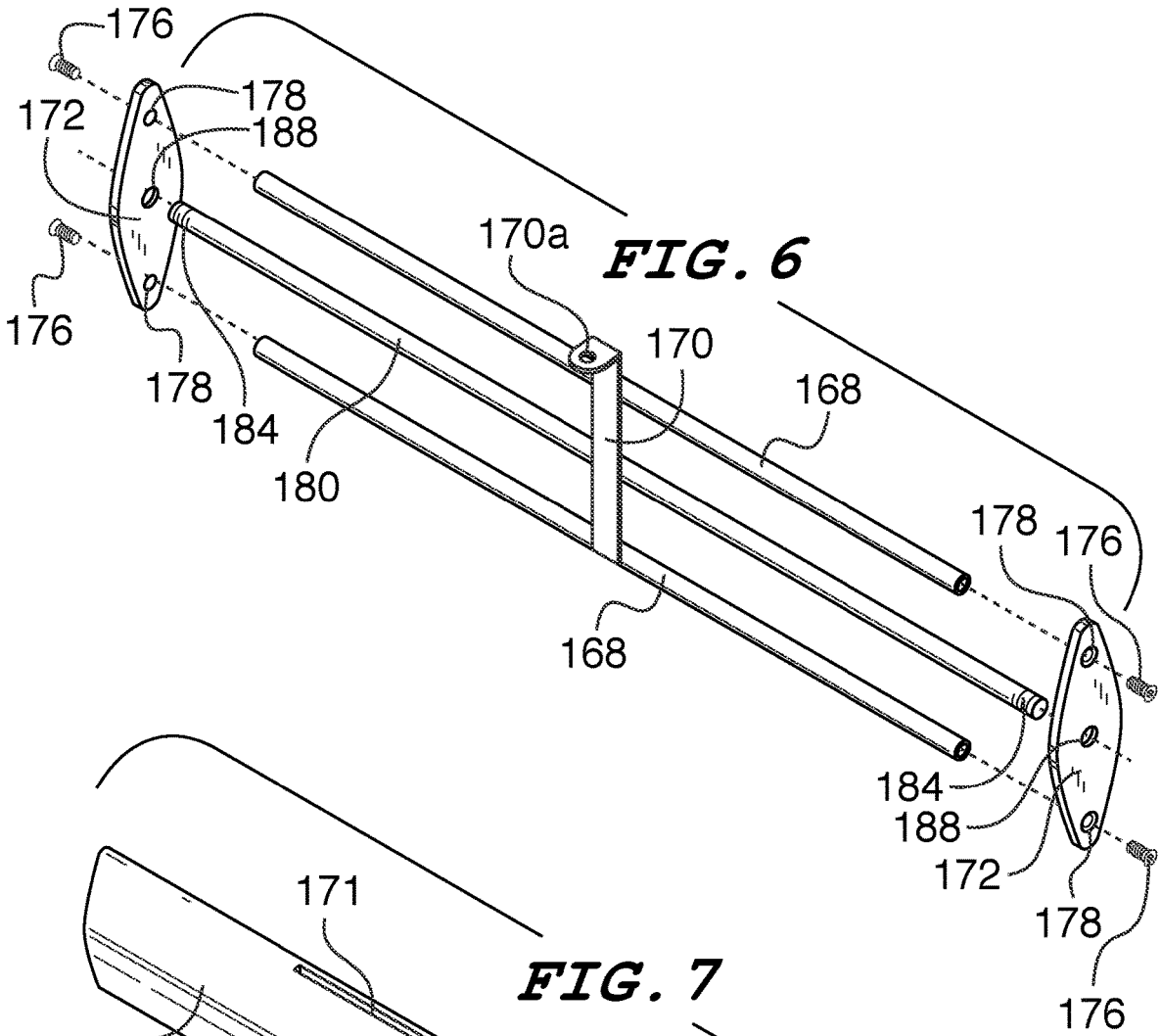
FIG. 6 is an exploded isometric view of internal components of a shutter slat of the present invention.
Figure 7:
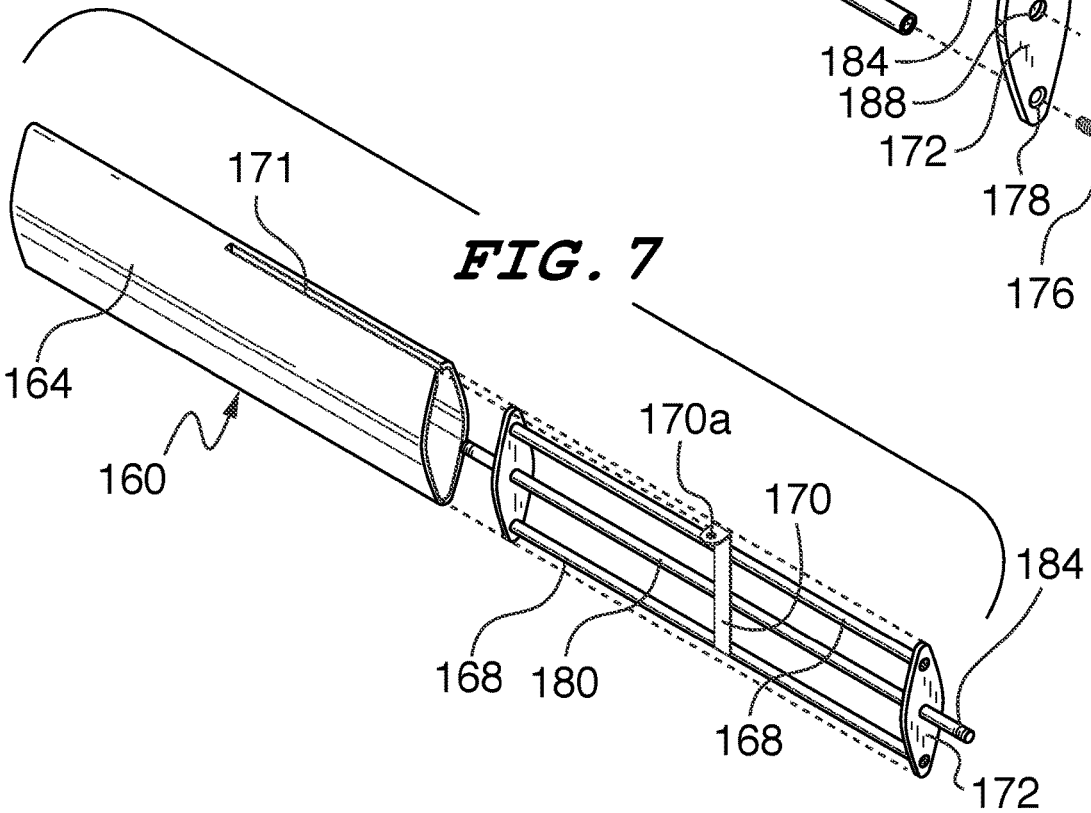
FIG. 7 is an exploded isometric view of a shutter slat of the present invention.

As best shown in FIGS. 1, 2 and 9, each shutter door 132 and 136 includes five shutter slats 160. In the exemplary embodiments illustrated in FIGS. 1 through 10, the shutter doors of the security shutter assembly are shown as having five slats 160 each. However, it should be borne in mind that any number of operable shutter slats 160 may be included in the embodiments of the present invention. Each of the shutter slats 160 is generally oval shaped in cross-section. Referring now to FIGS. 6 and 7, there is shown the various components of the completed shutter slat 160. Each shutter slat 160 includes a shell 164. The shell 164 is formed of an aesthetically pleasing material, e.g., a wood, a wood veneer, a composite wood, a faux wood, etc. Alternatively, each shutter slat 160 may be formed of a wood composite shell that is wrapped in a vinyl material or any other variation used by current shutter manufacturing companies.

Figure 7A:
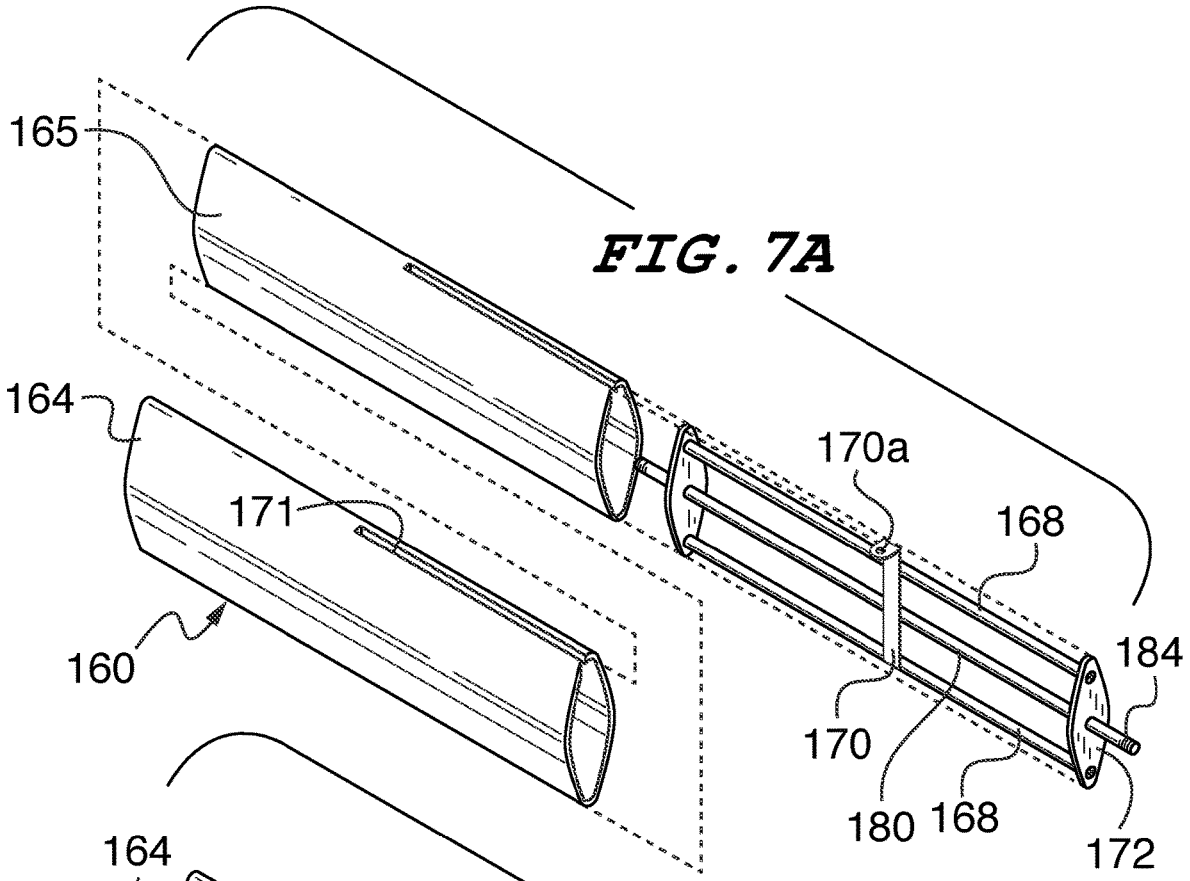
FIG. 7A is an exploded isometric view of an alternative shutter slat of the present invention.

Referring now to FIG. 7A, there is shown an alternative shutter slat 160 of the present invention. The alternative shutter slat 160 additionally includes a ballistic inner-sleeve 165 that is useful as armor against a variety of projectiles, e.g., various firearm rounds, which constitute ballistic threats. As best shown in FIG. 7A, the ballistic inner-sleeve 165 is arranged to be positioned over the skeletal structure of each slat 160. Once the ballistic inner-sleeve 165 is positioned over the skeletal structure, the decorative shell 164 is arranged to be positioned, e.g., slid, over the ballistic inner-sleeve to hide the ballistic inner-sleeve 165 from view. The ballistic inner-sleeve 165 is generally oval-shaped along its cross-section. The ballistic inner-sleeve 165 includes two faces, one of which serves as a strike face, i.e., the face directed towards the threat and with which a projectile first comes into contact. The opposite face is referred to as the back face.

Figure 7B:
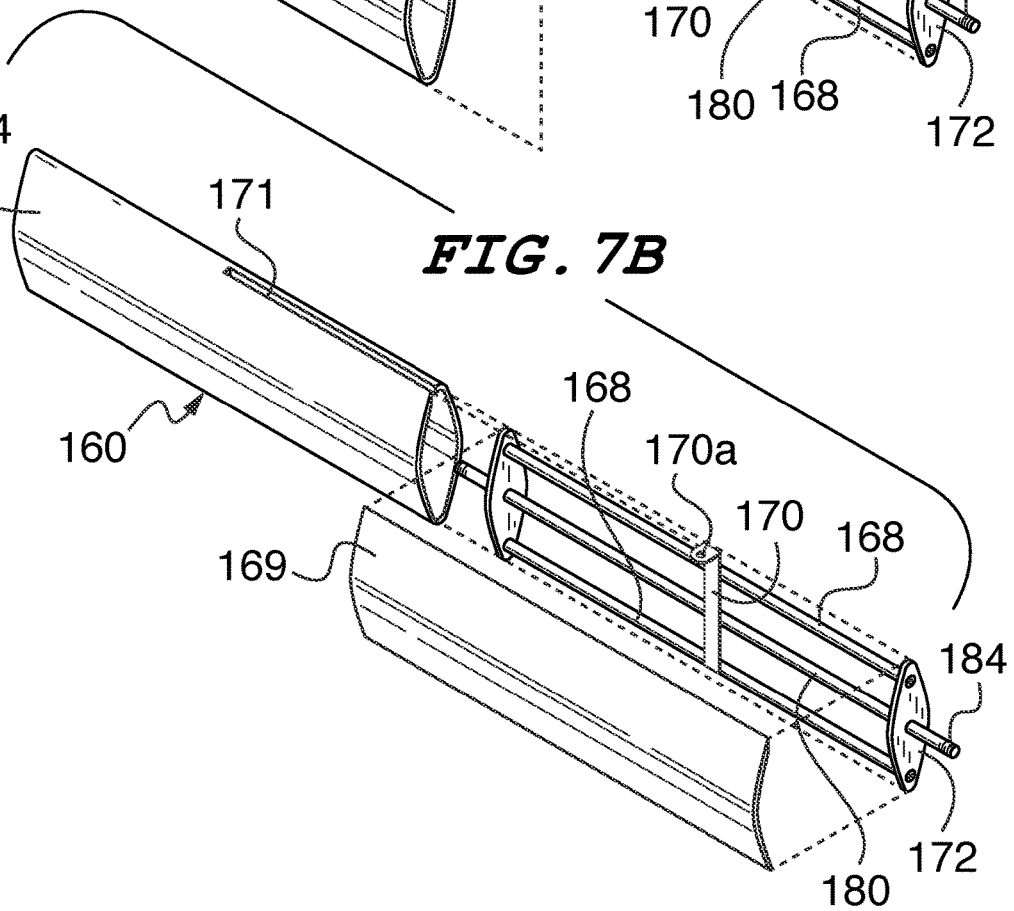
FIG. 7B is an exploded isometric view of a second alternative shutter slat of the present invention.

Referring now to FIG. 7B there is shown a second alternative shutter slat 160 of the present invention. The second alternative shutter slat 160 includes a curve-shaped ballistic panel 169 arranged to be positioned over one side of the skeletal structure of the slat 160. Once the ballistic panel 169 is positioned over the skeletal structure, the decorative shell 164 is positioned over the skeletal structure, the decorative shell 164 is arranged to be positioned over the ballistic panel 169 thus hiding the ballistic panel 169 from view. The ballistic panel 169 includes a strike face, i.e., the convex surface, but it does not include a back face, as does the ballistic inner-sleeve 165. The curve-shaped ballistic panel 169 is lightweight and may be formed of any suitable bullet-resistant materials.

The ballistic sleeve 165 (FIG. 7A) and the ballistic panel 169 (FIG. 7B) may be formed of any suitable bullet-resistant materials. Various kinds of fibers can be used in such a ballistic components, including organic, inorganic and/or metallic fibers, either alone or in combination. For example, fibers comprised of polyaramid material such as, among other things, those marketed under the trade name Kevlar may be used. In addition, other fiber types can be employed, such as, but not limited to ultra-high molecular weight polyethylene (UHNWPE).

The skeletal structure of each shutter slat 160 comprises a pair of spaced-apart storm bars 168 that extend parallel to each other along approximately the entire length of the shell 164. Each storm bar 168 is formed of a suitable hard material, e.g., a metal such as steel, steel composite, aluminum, or titanium, and includes a threaded internal bore at each end thereof for mounting purposes. Each shutter slat 160 includes a pair of generally oval-shaped end caps 172, each end cap 172 being arranged to be affixed at an end of the storm bars 168. Each end cap 172 includes a pair of through openings 178 to enable mounting of the end cap 172 to the storm bar 168 at each end thereof, utilizing a mounting screw 176 arranged to extend into the internal threaded bore of the storm bars 168. The end caps 172 may be formed of a suitable hard material, e.g., a metal such as steel, steel composite, aluminum, titanium, or other hard substance.

The skeletal structure also includes a centrally-located pivot rod 180 formed of a suitable hard material, e.g., a metal such as steel, steel composite, aluminum, titanium, or other hard substance, the pivot rod 180 having externally threaded ends 184. The pivot rod 180 is arranged to be located approximately midway between the spaced-apart storm bars 168 and is arranged to extend parallel therebetween. As best shown in FIGS. 6 and 7, the pivot rod 180 is slightly greater in length than the storm bars 168. In this manner, as best shown in FIGS. 6, 7 and 9, when the spaced-apart storm bars 168 are affixed to the end caps 172, the pivot rod 180 is arranged to extend through central openings 188 in each end cap 172 and through the slat mounting openings 162*a* located on the inside surface of each shutter column 140. Suitable hardware, e.g., internally threaded tension bolts 192 may be seated into slat mounting openings 162*b* located on the outside surface of each shutter column 140 and fastened to the pivot rod 180 to position each shutter slat 160 between the shutter columns 140. In the manner, the shutter slats 160 are free to rotate about the non-rotatable pivot rod 180 between closed and open positions, as conventional shutter slats operate. Due to the inclusion of the storm bars 168 and the pivot rod 180, the shutter slats 160 are strong enough to withstand high winds, flying debris, and falling objects caused by severe weather, for example. Due to their ruggedized construction, the shutter slats 160 are also strong enough to withstand attempted intrusions. The storm bars 168 and pivot rod 180 prevent the slats from bending so much that they slip out of the shutter columns 140. The materials chosen for construction of the metal skeleton structure will be dictated by considerations including the level of protection desired by the customer, the size of the shutter assembly application, cost, weight, etc.

Figure 10:
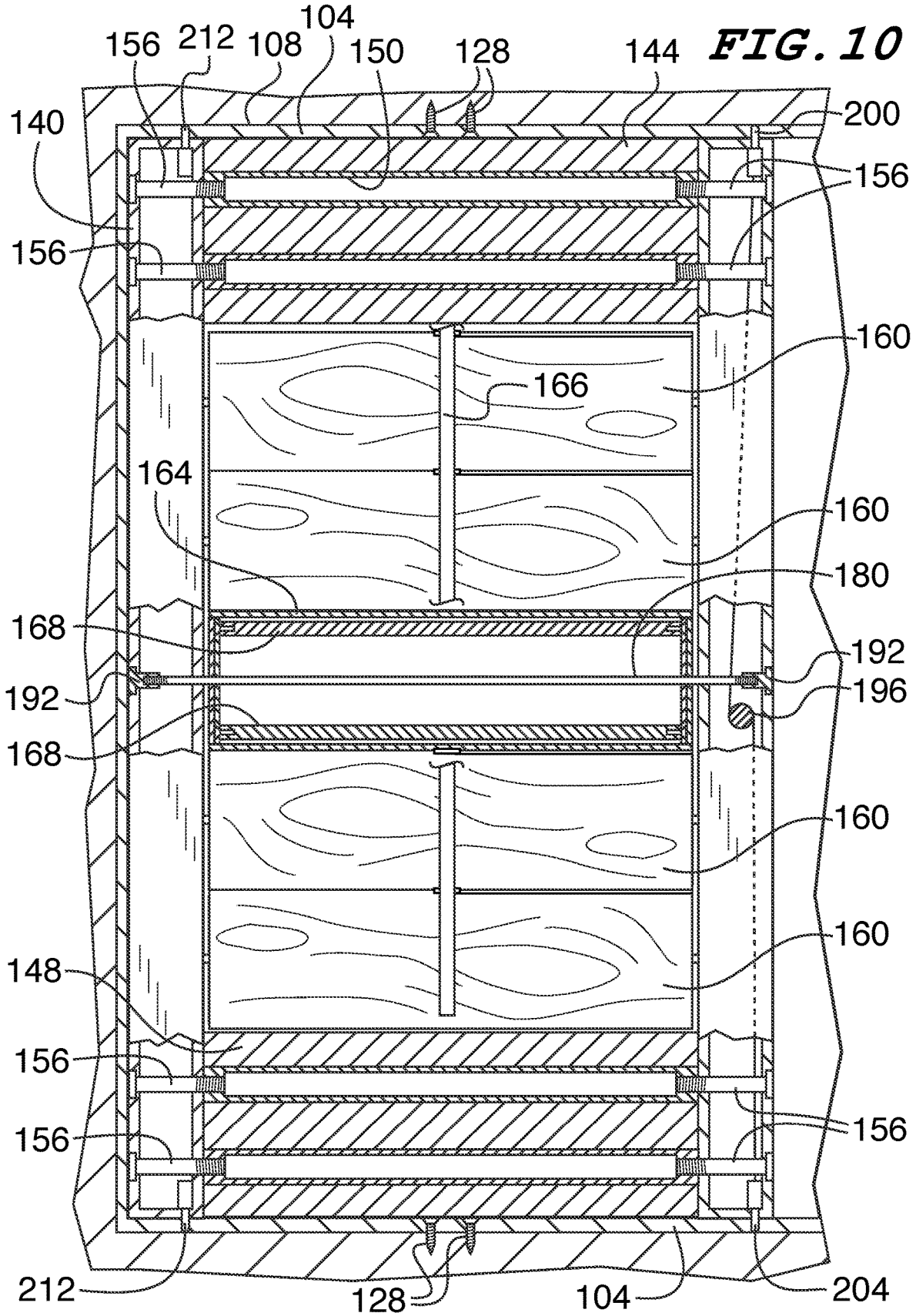
FIG. 10 is a sectional view taken along line 10-10 of FIG. 2.

Referring now to FIGS. 2, 9 and 10, each shutter door 132 and 136 includes door a locking mechanism arranged to move from an unlocked position to a locked position wherein each shutter door 132 and 136 is locked within the mounting frame 104. As best shown in FIG. 10, the door locking mechanism includes a rotatable door locking element 196 which is housed within the shutter columns 140. The door locking element 196 is attached to or integral with a rotatable door locking knob 198 positioned on the exterior surface of the shutter column 140 directed to the interior of the building. The door locking knob 198 may include a decorative shape and/or decorative surfaces to match the decorative aesthetic of other components of the shutter doors 132 and 136. The door locking element 196 (FIG. 10) is also in engagement with extendable and retractable door locking bolts 200 and 204 (FIG. 10). When the door locking knob 198 is manually rotated, the door locking element 196 is caused to rotate causing the door locking bolts 200 and 204 to move from a retracted unlocked position to an extended locked position as shown in FIGS. 2, 9 and 10. With the shutter door in the closed position, as the door locking bolts 200 and 204 move to the extended position, they extend through openings 208 (FIG. 5) located in the mounting frame 104 to engage the shutter doors in a locked position to the mounting frame 104. Likewise, when the door locking knob 198 is rotated in the opposite direction, the door locking bolts 200 and 204 are caused to move from the extended or locked position to the retracted position to unlock the shutter doors 132 and 136 and allowing them to move pivotally on pins 212 which also extend through openings 208 located in the mounting frame 104. Optionally, the pins 212 may be spring loaded to form a spring hinge system. It should be mentioned that although FIGS. 2, 9 and 10, illustrate the locking mechanism 196 disposed within the shutter columns 140, it should be noted that the door locking mechanism 196 can be located outside the shutter column and interior to the building, as dictated by design preferences.

The shutter slats 160 are arranged to rotate in unison between open and closed positions, in a manner similar to standard shutters. As shown in the figures, when the shutter doors 132 and 136 are locked within the frame 104, and the shutter slats 160 are in the closed and locked position (substantially vertical), they overlap to withstand high winds, block any incoming debris, and withstand attempted intrusions, such as by vandals and thieves. In this manner, the underlying structure is effectively protected from such exterior forces. When the shutter slats 160 are in the open position, i.e., substantially horizontal, air and light are allowed to enter on a horizontal path. The shutter assembly 100 also acts as a sun shade, with obvious added cooling benefits.

Referring now to FIGS. 1, 2, 3 and 9, each of the shutter doors 132 and 136 is provided with a centrally-located vertically oriented adjustment bar 166. By raising and lowering the adjustment bar 166, the slats 160 may be manually adjusted as a group from the opened position to the closed position, as well as to all positions therebetween, similar to conventional shutters. As best shown in these figures, the adjustment bar 166 is shown raised to an uppermost position to place the shutter slats 160 in the closed position.

Specifically, each adjustment bar 166 includes a plurality of evenly-spaced closed rings 167 positioned at equidistant locations along the length thereof. Each closed ring 167 is shown as being generally U-shaped, however, it should be understood that this shape is merely exemplary. As best shown in FIGS. 6, 7 and 9, each slat 160 includes a tab 170 positioned approximately midway across the length of the storm bars 168, the tab 170 extending upwardly from the storm bar 168 and bending at an angle of approximately ninety degrees. Each tab is arranged to extend through a slot 171 located in the shell 164 of each shutter slat 160. At its free end, each tab 170 includes a circular opening 170*a* at the forward end thereof (FIG. 7). Each opening 170*a* is arranged for one of the closed rings 167 to extend therethrough. In this manner, the vertically oriented adjustment bars 166 are attached to each of the slats 160 in the shutter door (132 and 136) thus enabling a user to adjust the position of the slats 160 as a group from the opened position to the closed position, and to any desired position therebetween, similar to conventional shutters. It should be understood that the dimensions of various components described above, e.g., the shutter columns 140, the horizontal members 144, 148, and the slats 160 of the security shutter assembly 100 may be adjusted to suit the dimensions of the opening in which the assembly is to be mounted.

Figure 4:
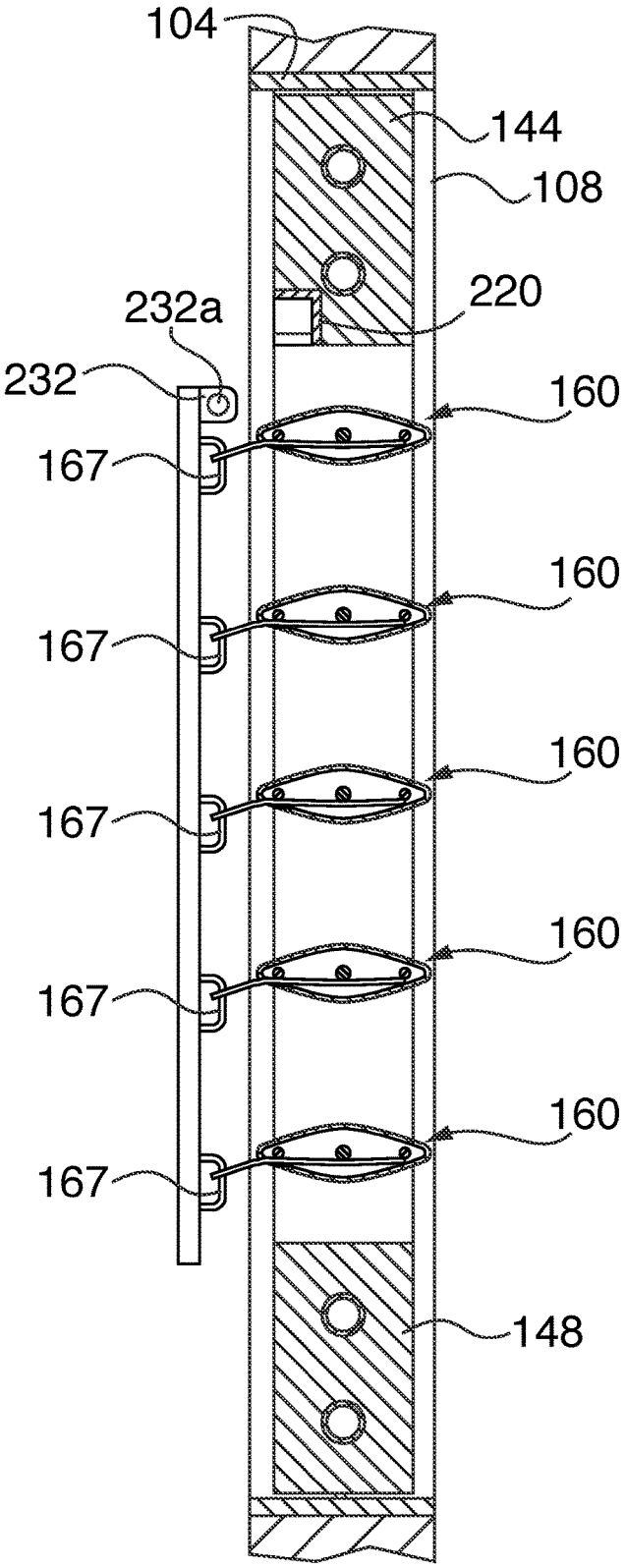
FIG. 4 is a sectional view of a shutter door illustrating the shutter slats in the open and unlocked position.

Referring now to FIGS. 3, 4, 8, 8A and 8B, the upper horizontal member 144 is shown as including a large rectangular-shaped recess located in the lower portion thereof arranged for receiving and retaining therein a lock body 220 which may be mounted therein by any suitable means, e.g., suitable hardware such as mounting screws (not shown) extending through mounting tabs (not shown) located on the lock body 220. By mounting the lock body 220 within the recess of the upper horizontal members 144, tampering of the lock body 220 is inhibited. Each lock body 220 includes a vertical slot 228 arranged to receive therein a locking tab 232. The locking tab 232 may be integral with or attached to the upper end of each adjustment bar 166. The locking tab 232 extends horizontally from the upper end of the adjustment bar 166 (FIG. 4). Each locking tab 232 includes a circular opening 232*a* sized to receive an "L" shaped lock bolt 236 therethrough. The "L" shaped lock bolt 236 is held captive within a horizontal slot 238 of the lock body 220 and is arranged to move between a right-most retracted and a left-most extended positions.

As best illustrated in FIGS. 3, 4, 8A and 8B, when the "L" shaped lock bolt 236 is in the retracted position, the vertical slot 228 is unobstructed thus allowing insertion of the locking tab 232 therein. When the adjustment bar 166 is raised to its uppermost position, the slats 160 are moved to their closed position (FIG. 3), and the locking tab 232 is arranged to enter the unobstructed vertical slot 228 of the lock body 220 as indicated by arrow 237 in FIG. 8B. Once the locking tab 232 is seated within the unobstructed vertical slot 228, the lock bolt 236 may be moved leftwardly (as indicated by arrow 239 in FIG. 8B) from its retracted position and through the circular opening 232*a* of the locking tab 232 to its extended position to retain the adjustment bar 166 in its uppermost position and to secure the slats 160 in the closed position. In this manner, movement of the slats 160 from the closed position is inhibited to withstand attempted intrusions, such as by vandals and thieves. Thus, when the shutter doors 132 and 136 and the slats 160 are in the closed and locked position, the underlying structure is effectively protected from such exterior forces.

When the user wishes to have free movement of the slats 160, the lock bolt 236 may be moved rightwardly from its left-most extended position to its right-most retracted position to enable disengagement of the adjustment bar 166 therefrom and to enable movement of the slats 160 from the closed position to any open position, such as to allow light and air to enter the window.

Figure 11:
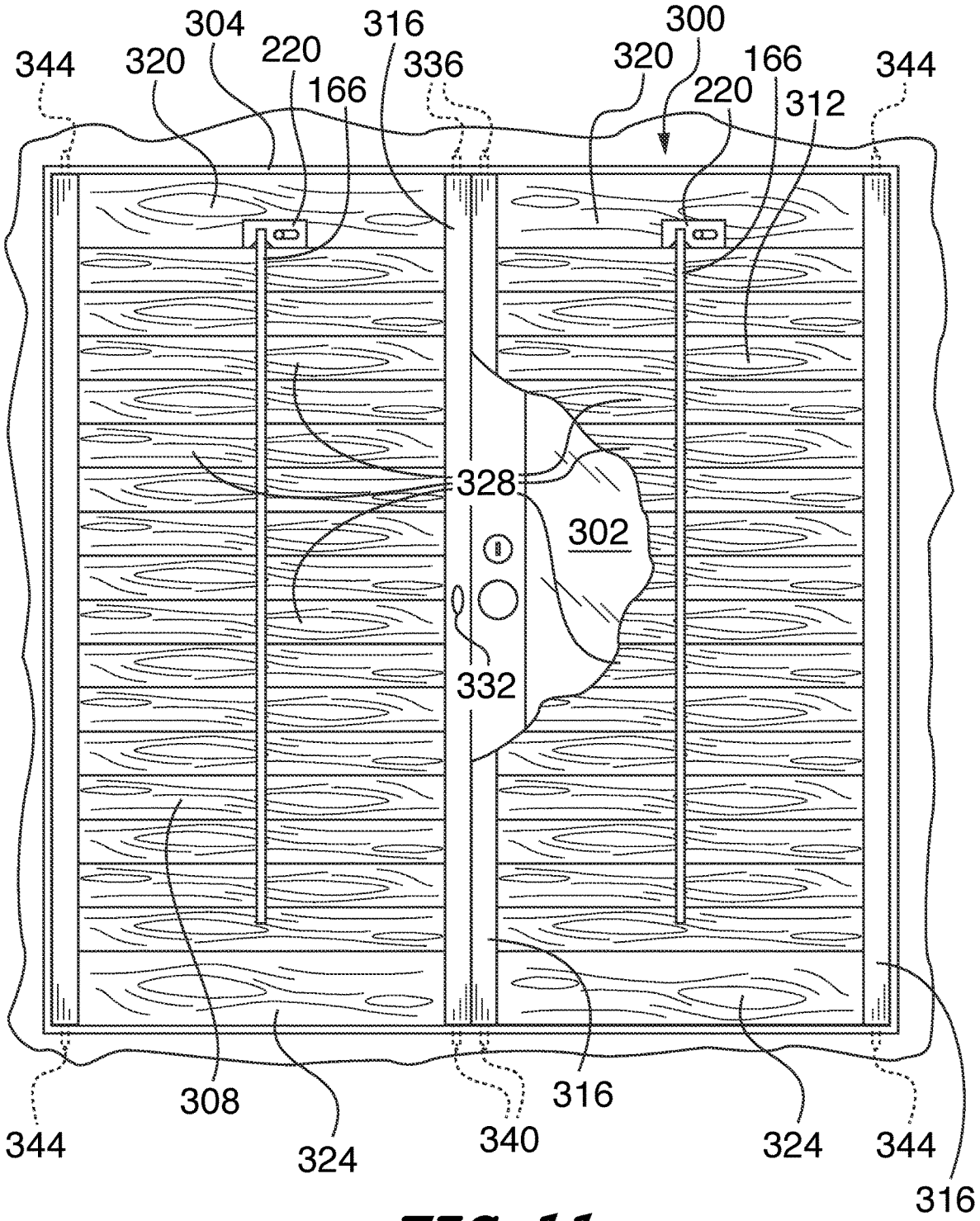
FIG. 11 is an elevational view of a second embodiment of the present invention, wherein the security shutter assembly of the present invention is mounted in an opening for a door.

Referring now to FIG. 11, a second embodiment 300 of the invention is shown. In similar fashion to the preferred embodiment, the second embodiment 300 includes a generally rectangular-shaped mounting frame 304 arranged for mounting the second embodiment 300 within an opening located interior to a door, such as French doors 302 in a residential building. Similar to the preferred embodiment, the mounting frame 304 is provided with mounting holes (not shown) to enable the mounting frame 304 to be mounted utilizing suitable mounting hardware. Similar to the preferred embodiment, the second embodiment 300 includes a pair of shutter doors hingedly mounted within the mounting frame 304, including a left shutter door 308, and a right shutter door 312. Each shutter door (308 and 312) is formed of a pair of vertically-oriented shutter columns 316, similar in construction to those described in connection with the preferred embodiment. Likewise, each shutter door (308 and 312) includes an upper horizontal member 320 and a lower horizontal member 324, each horizontal member being similar in construction to the upper and lower horizontal members described in the preferred embodiment. The upper and lower horizontal members 320 and 324 may include a decorative surface simulating wood or another aesthetically pleasing surface. Each shutter door 308 and 312 includes sixteen shutter slats 328. It should be understood that the number of shutter slats 328 illustrated in FIG. 11 is merely exemplary, and a greater or lesser number of shutter slats 328 could be employed within the shutter door 308, 312 without departing from the present invention. As discussed in the preferred embodiment, each shutter slat may include a decorative surface, e.g., simulated wood.

As with the preferred embodiment, each shutter door (308, 312) includes a locking mechanism arranged to move from an unlocked position to enable hinged movement of each shutter door from a closed position to an open position, to a locked position wherein each shutter door 308, 312 is locked within the mounting frame 304. The locking mechanism includes a rotatable locking knob 332 positioned on the exterior surface of the shutter column 316 in which a rotatable locking element (not shown) is housed. The locking knob 332 may include a decorative shape and/or decorative surfaces to match the decorative aesthetic of the shutter door 308, 312. The locking element (not shown) is in engagement with extendable and retractable locking pins 336, 340. When the locking knob 332 is manually rotated, the locking element (not shown) rotates causing the locking pins 336, 340 to extend from a retracted unlocked position to an extended locked position. In FIG. 9, the locking pins 336 and 340 are shown in the extended locked position. As the locking pins 336, 340 move to the extended position, they extend through openings (not shown) located in the mounting frame 304 to engage the shutter doors 308, 312 in a locked position to the mounting frame 304. Likewise, when the locking knob 332 is rotated in the opposite direction, the locking pins will move from the extended or locked position to the retracted position to unlock the shutter doors 308, 312 allowing them to move pivotally on pivot pins 344. Likewise, a lock body 220 is provided to retaining the shutter slats 328 in a closed position as described in the first embodiment.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

What is claimed is:

1. A decorative shutter assembly securable to an opening of a building for security and storm protection, said shutter assembly comprising:

a. a mounting frame formed of metal and configured for mounting around a perimeter of the opening and being located interior to a window or door;

b. at least one shutter door configured to be hingedly mounted within said mounting frame, said shutter door including horizontal upper and lower members and opposed vertical shutter columns extending vertically between respective ends of said horizontal upper and lower members, said vertical shutter columns including a plurality of aligned apertures, said at least one shutter door being configured to move from a closed position to an open position and to positions therebetween, said at least one shutter door additionally comprising a selectively actuatable locking mechanism moveable to alternatively lock and unlock said at least one shutter door relative to said mounting frame;

c. a plurality of operable shutter slats extending horizontally between said vertical shutter columns, each said operable shutter slat including an elongate shell having a decorative surface disposed over an inner skeletal structure, said elongate shell having a pair of open ends, said inner skeletal structure comprising a pair of spaced-apart storm bars, a pair of spaced-apart end caps, and a pivot rod, each of said spaced-apart storm bars being an elongate member formed of metal extending the length of said shell and having a pair of ends and a longitudinal horizontal axis extending between said pair of ends, each of said spaced-apart end caps being a planar member lying in a plane perpendicular to said longitudinal horizontally extending axis and formed of metal, said spaced-apart end caps being affixed to respective ones of said pair of ends of said storm bars by respective threaded fasteners extending along said longitudinal horizontal axis, whereupon said spaced-apart end caps close said open ends of said elongate shell, and each pivot rod being an elongated member formed of metal and extending the length of said elongate shell and through apertures located in said spaced-apart end caps, each pivot rod arranged for mounting having respective ends mounted within respective ones of said aligned apertures of said vertical shutter columns to enable pivotal movement of said plurality of operable shutter slats between closed and open positions, each said operable shutter slat additionally including a ballistic inner sleeve positioned between said elongate shell and said inner skeletal structure;

d. a vertically oriented adjustment bar configured to move said plurality of operable shutter slats in unison between said closed and open positions; and e. a lock body housed within said horizontal upper member of each shutter door and being configured to engage said vertically oriented adjustment bar to inhibit movement of said plurality of operable shutter slats from said closed position.

2. The shutter assembly of claim 1, wherein each said elongate shell includes a surface formed of wood.

3. The shutter assembly of claim 1, wherein each said elongate shell is formed of a composite wood with vinyl wrapping.

4. The shutter assembly of claim 1, wherein said horizontal upper and lower members additionally comprise at least one steel tube located therein.

5. The shutter assembly of claim 1, wherein said horizontal upper and lower members are each formed of a solid block of wood.

6. The shutter assembly of claim 1, wherein said opposed vertical shutter columns are formed of steel tubes.

7. The shutter assembly of claim 1, wherein said end caps are generally oval in shape.

8. The shutter assembly of claim 1, wherein said storm bars, said spaced-apart end caps, and said pivot rod are formed of a material selected from the group consisting of steel, steel composite, aluminum, and titanium.

9. The shutter assembly of claim 1, wherein said locking mechanism comprises at least one locking bar moveable between a first state, in which said locking bar is configured to engage with said mounting frame to lock said shutter door against movement, and a second state, in which said locking bar is configured to avoid engagement with said mounting frame.

10. The shutter assembly of claim 1, wherein said at least one shutter door comprises a pair of opposed shutter doors each hingedly mounted within said mounting frame.

11. The shutter assembly of claim 1, wherein said ballistic inner sleeve is formed of a material selected from the group consisting of inorganic fibers, metallic fibers, fibers formed of a polyaramid material, and fibers formed of ultra-high molecular weight polyethylene.

* * * * *